United States Patent [19]

Pearlman

[11] 4,075,808

[45] Feb. 28, 1978

[54] BUILDING CONSTRUCTION SYSTEM USING MORTAR-LESS MODULAR BUILDING BLOCK ELEMENTS

[76] Inventor: Sanford Pearlman, 25218 Parkwood, Huntington Woods, Mich. 48060

[21] Appl. No.: 681,134

[22] Filed: Apr. 28, 1976

Related U.S. Application Data

[63] Continuation of Ser. No. 527,088, Nov. 25, 1974, abandoned.

[51] Int. Cl.[2] ..... E04B 2/00; E04B 5/48

[52] U.S. Cl. ..... 52/439; 52/503; 52/589; 52/592

[58] Field of Search ..... 52/439, 436, 438, 589, 52/293, 396, 259, 286, 503, 742, 592

[56] References Cited

U.S. PATENT DOCUMENTS

| | | | |
|---|---|---|---|
| 1,892,605 | 12/1932 | Betzler | 52/293 |
| 2,684,589 | 7/1954 | Perreton | 52/439 X |
| 2,687,034 | 8/1954 | Blanc | 52/396 X |
| 3,222,830 | 12/1965 | Ivany | 52/438 X |
| 3,410,044 | 11/1968 | Moog | 52/589 X |
| 3,717,967 | 2/1973 | Wood | 52/259 |
| 3,888,060 | 6/1975 | Haener | 52/589 X |
| 3,895,148 | 7/1975 | Chang | 52/589 X |
| 3,962,842 | 6/1976 | Wilhelm | 52/589 X |
| 3,968,615 | 7/1976 | Ivany | 52/439 |

*Primary Examiner*—Price C. Faw, Jr.
*Assistant Examiner*—Robert C. Farber
*Attorney, Agent, or Firm*—Hauke & Patalidis

[57] ABSTRACT

A building construction modular system utilizing interlocking building blocks made of aggregate material and having opposite side faces vertically and horizontally offset from the main body portion of the block. A structure, such as a wall, is erected by laying superimposed horizontal courses of vertically interlocked blocks, the blocks of a course being interlockingly supported by the blocks of the subjacent course. Each block element is provided with a vertically disposed passage or aperture and with a vertically directed recess at each lateral end of the block where it interlocks with an adjoining block element and the integrally formed transverse walls joining the side faces of each block are appropriately apertured such that, after the wall has been erected, cement is poured into the block structure from the tops of the blocks on the upper course, so as to flow vertically and horizontally through the passages and apertures within the blocks. Once set, the cement forms a lattice disposed inside the blocks, which strongly adheres to the interior surface of the blocks and rigidly holds the blocks in position. If so required, reinforcing metal rods or other elements are disposed horizontally and vertically through the passages prior to pouring the cement. The offset end faces of the blocks provide effective dams preventing the seepage of the liquid cement to the outside surface of the wall. The invention further contemplates appropriate corner blocks, wall end blocks, and interior wall connecting blocks, such that a complete system of modular element construction is provided by the invention.

21 Claims, 21 Drawing Figures

FIG. 1
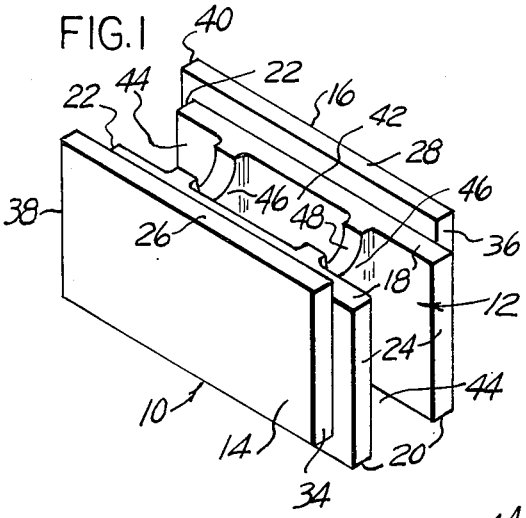
FIG. 3
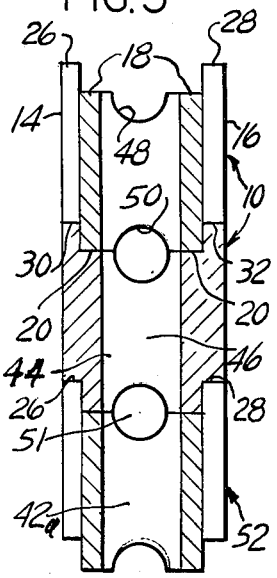
FIG. 2
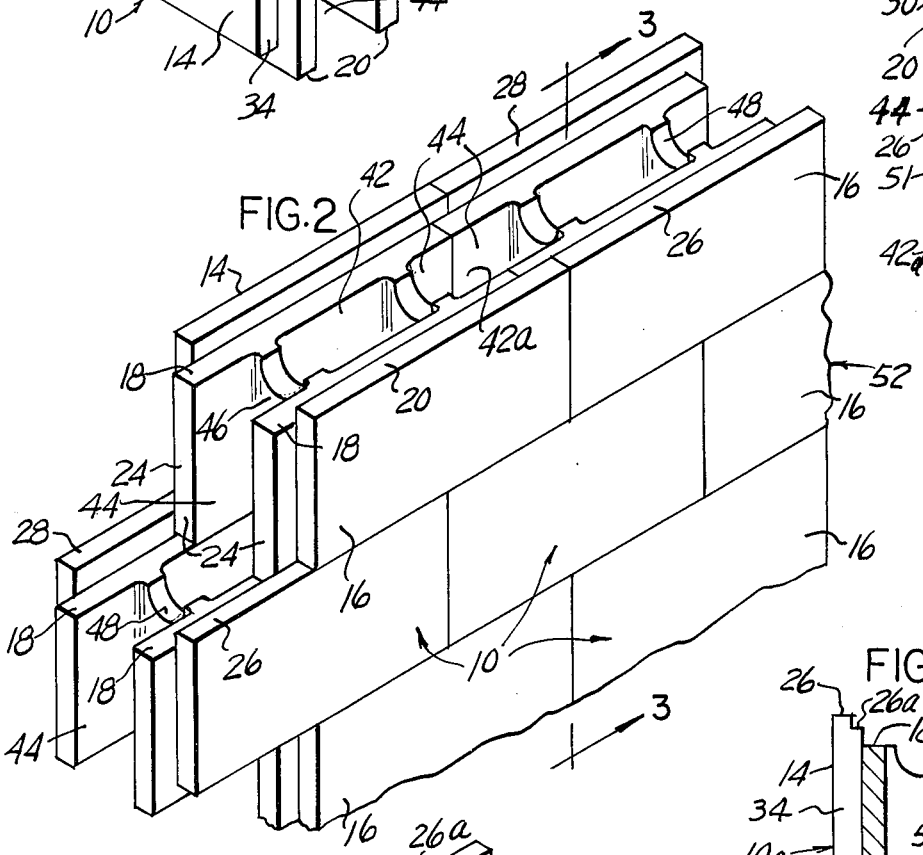
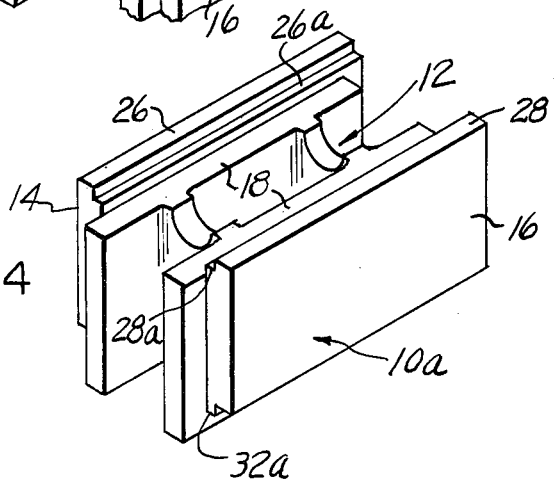
FIG. 4
FIG. 5
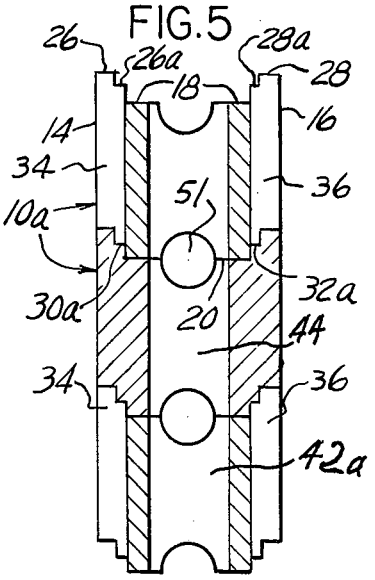

FIG. 9
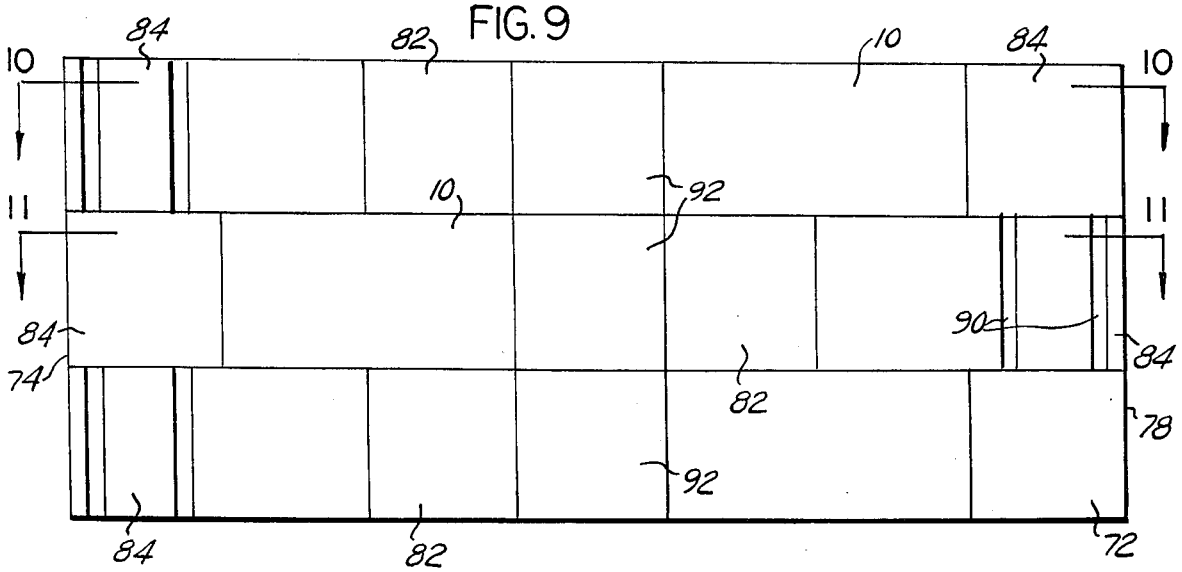
FIG. 8
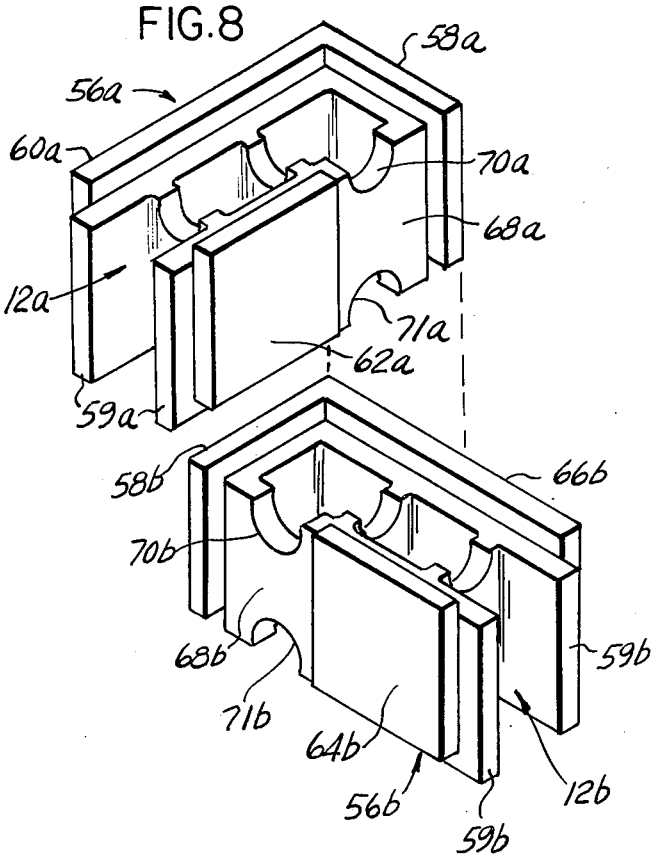
FIG. 7
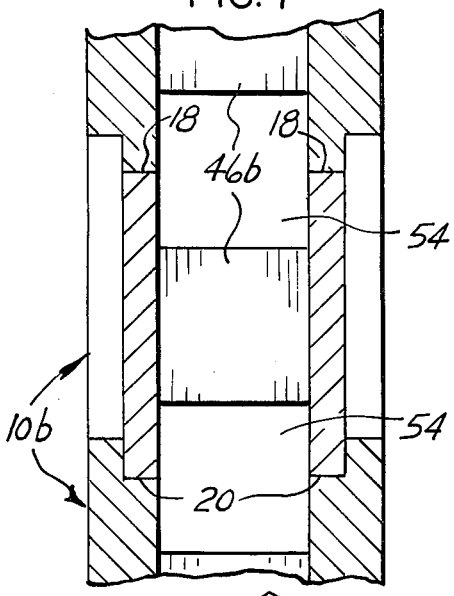
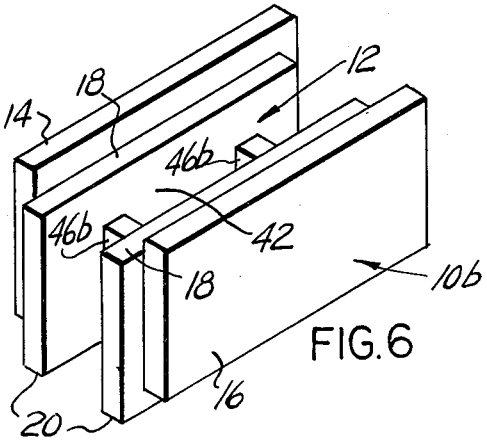
FIG. 6

BUILDING CONSTRUCTION SYSTEM USING MORTAR-LESS MODULAR BUILDING BLOCK ELEMENTS

CROSS-REFERENCE TO RELATED APPLICATIONS

The present application is a continuation of application Ser. No. 527,088 filed Nov. 25, 1974, now abandoned.

BACKGROUND OF THE INVENTION

The present invention relates generally to novel building block construction elements, and more particularly to a building construction system utilizing interlocking modular block members which can be used to form continuous wall sections with overlapping mortar-less joints, and which are adaptable to the construction of outside wall sections as well as interior wall sections, and which comprises corner blocks, wall end blocks, and internal wall connecting blocks.

Attempts have been made in the past to overcome the shortcomings and disadvantages of conventional masonry structures utilizing building elements such as bricks, cement blocks, cinder blocks and the like. Such conventional masonry elements are used for erecting wall structures on an appropriate foundation by way of laying successive superimposed horizontal rows or courses of bricks or blocks united by means of horizontal and vertical mortar joints. Such mortar joints often show poor adherence to the surfaces of the masonry elements, and are relatively porous with the result that they are not entirely impervious to seepage of water or penetration by moisture. Mortar joints are consequently the weakest element of a wall, or other structure, build by conventional means, they provide a poor barrier to heat, cold, moisture, and they deteriorate relatively more rapidly than the rest of the structure. Furthermore, building a structure by means of conventional masonry united by vertical and horizontal mortar joints requires substantial skill on the part of the worker in order to trowel the right amount of mortar of the right consistency at each joint and in order to constantly maintain courses upon courses of bricks or building blocks perfectly level and a plurality of superimposed courses along a perfect plumb line. It is also obvious that in addition to being relatively slow, time consuming, and requiring a reasonable amount of care and skill, conventional building systems utilizing masonry elements interconnected by vertical and horizontal mortar joints are subject to cracking at the mortar joints which form the weakest part of the whole structure.

The present invention, by contrast, by providing interlocking building block elements having overlapped mortar-less joints disposed horizontally and vertically with a solid mass of cement behind each joint, permits to erect continuous wall surfaces which are impervious to snow, rain, cold, wind, and moisture. Courses upon courses of building block elements may be laid rapidly by relatively unskilled labor, without resorting to the use of mortar, adhesives, tie rods or the like until a structure of considerable height has been erected, such as for example ten to fifteen feet high, at which time mortar or cement is poured from the top of the structure and allowed to flow vertically and horizontally within the opposite faces of the structure through the aligned passages provided by the building elements configuration of the present invention. Once the mortar or cement is set, additional courses of building blocks can be laid until another increment of a further ten to fifteen feet height, for example, is achieved, at which time mortar or cement is again poured from the top into the structure. If so desired to increase the strength of the structure, or for permitting to build structures of considerable height, horizontal and vertical reinforcing rods or plates of iron, steel, or other reinforcing material may be positioned in the interior of a wall structure through the vertical and horizontal passages provided in the building elements, prior to the pouring of mortar or concrete. The passages, additionally, may be used for routing appropriate pipes, conduits and lines to provide the distribution of utilities by means of appropriate outlets at diverse locations on the interior or exterior of a wall structure.

SUMMARY

The present invention accomplishes its diverse objects by providing a novel construction system based on modular building blocks or elements having horizontally and vertically projecting edges on opposite faces so as to form overlapping interlocking joints, which require no mortar or other adhesive at the joints, and which in practice act as a form or mold into which cement, mortar, concrete or the like may be poured and distributed throughout the interior of a structure made of such blocks by way of appropriate passages, such that the poured material, once set, forms a lattice intimately bounded to the block interior surfaces such as to form a strong rigid monolithic structure. In addition, the present invention provides a modular system for building construction which comprises mortar-less full blocks, half blocks, adaptor blocks, wall end blocks, corner blocks, and wall junction blocks, permitting to erect a complete structure according to the principle of the invention.

The many objects and advantages of the present invention will become apparent to those skilled in the art when the following description of the invention is read in conjunction with the accompanying drawing wherein:

BRIEF DESCRIPTION OF THE DRAWINGS

FIG. 1 is a perspective view of an example of a building block element according to the present invention;

FIG. 2 is a perspective view of a portion of a wall made by laying course upon course of building block elements according to FIG. 1, disposed end to end in each course;

FIG. 3 is a transverse section through the wall structure of FIG. 2 along line 3—3 thereof;

FIG. 4 is a perspective view of a modified building block element according to the present invention;

FIG. 5 is a view similar to FIG. 3 but utilizing the building block element of FIG. 4;

FIG. 6 is a perspective view of a further modification of a building block element according to the present invention;

FIG. 7 is a transverse partial sectional view through a portion of a wall structure made by superimposing course upon course of the building block elements of FIG. 6;

FIG. 8 is a perspective exploded view of the assembly of an example of two corner blocks according to the present invention;

FIG. 9 is a contracted end view of an example of a building structure according to the present invention;

DETAILED DESCRIPTION OF THE PREFERRED EMBODIMENTS

Figure 10:
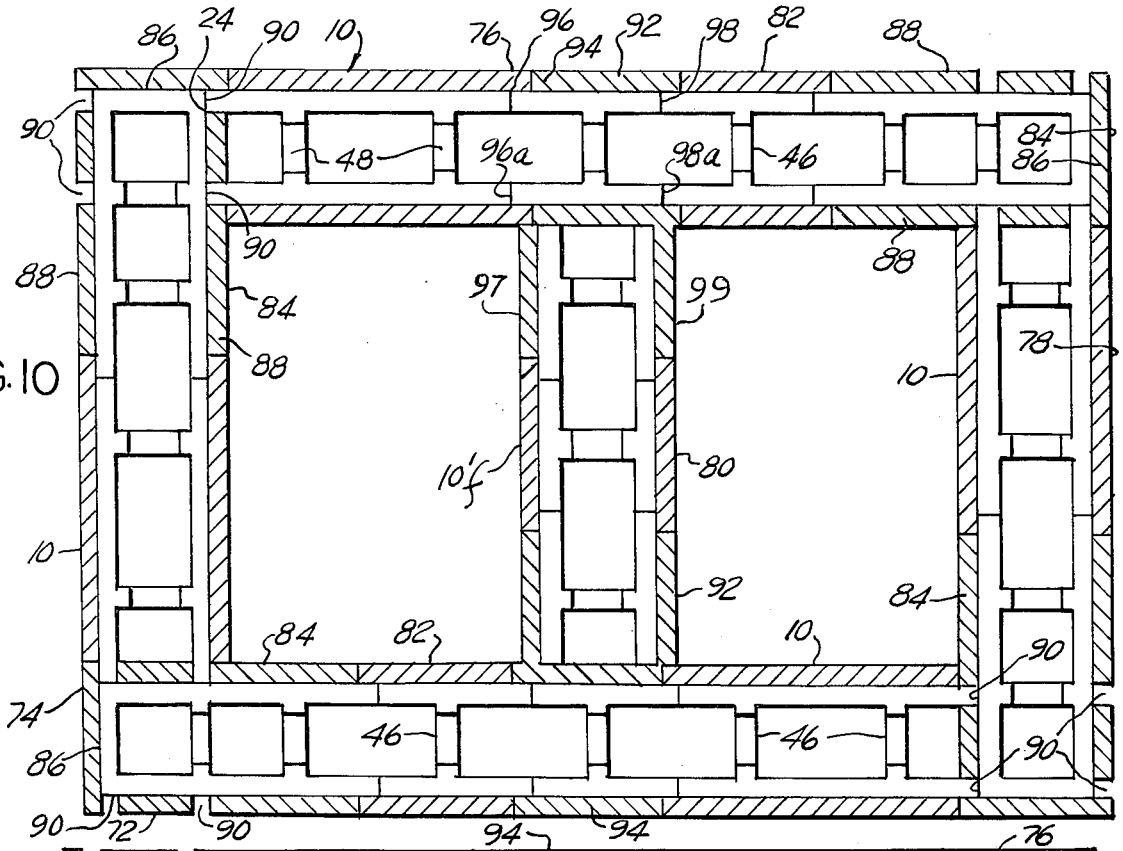
FIG. 10 is a horizontal section along line 10—10 of FIG. 9.

The present invention contemplates a novel modular building system through the use of interlocking block elements, an example of a full block being shown in perspective at 10 at FIG. 1. The full building block 10 comprises a main body portion 12 provided with substantially parallel opposite side face slab portions 14 and 16 integrally molded with the main body portion 12. The full building block 10 is molded of aggregate material such as concrete, cement or other convenient material in modified cement block molding apparatus. The main body portion 12 of the full block 10 is of a generally parallelepipedonal shape, with an upper and lower uniplanar face 18 and 20 and uniplanar lateral end faces 22 and 24. The upper edge surfaces 26 and 28 of the side face slab portions 14 and 16, respectively, are disposed in a single plane which projects a predetermined distance from the plane of the main body portion upper end face 18. Similarly, the lower edge surfaces of the side face slab portions 14 and 16, as shown at 30 and 32 at FIG. 3, are each recessed of the same amount relative to the lower face 20 of the main body portion 12 of the block, such that the lower face 20 of the main body portion 12 projects beyond the side face slab portions 14 and 16 in the same proportion as the upper end face 18 of the block main body portion is recessed from the upper edge surfaces 26–28 of the side face slab portions 14 and 16. The lateral end face 24 of the main body portion 12 of the full block 10 projects beyond the edge end surfaces 34 and 36 of the side face slab portions 14 and 16 of a given distance corresponding to the distance at which the other end face 22 of the main body portion is recessed relative to the end edge surfaces 38 and 40 of te side face slab portions 14 and 16, FIG. 1. The block 10 is molded, with cores disposed within the mass of aggregate material as to form a vertically disposed aperture 42, substantially at the center of the block 10, and a vertically oriented end recess 44 disposed at each end of the block main body portion 12, the central aperture or opening 42 being separated from each end recess 44 by an integrally molded transverse wall or cross member 46. Each of the walls or cross members 46 has a recess or cut-out portion 48 formed preferably at the top thereof or, alternatively as best shown at FIG. 3, cut-out portion 48 formed at the top and a cut-out portion 50 formed at the bottom of the wall or cross member 46.

For the purpose of building a structure, such as a wall 52, FIGS. 2 and 3, a first row or course of full blocks 10 is laid on an appropriate foundation, and successive superimposed courses of blocks are subsequently laid with each block of every course staggering a pair of abutting blocks of the course immediately below. It can also be seen at FIG. 2 that all the blocks 10 in the wall structure 52 are interlocked at their lateral ends with the end faces 24 of each block main body portion 12 projecting within the ends 38 and 40 of the side face slab portion, and the blocks in an upper course being interlockingly supported by the blocks in the course immediately below as a result of the edge surfaces 26 and 28 of the block in the subjacent course abutting against the lower edge surfaces 30 and 32 of the side slab portions 14 and 16, respectively, and of the uniplanar surface 18 of the block main body portion abutting the uniplanar surface 20 of the main body portion of the block disposed immediately above. The cut-out portions 48 and 50 disposed respectively at the top and bottom of each wall or cross member 46, as shown at FIG. 3, provide horizontally disposed passages 51 between consecutive vertical rows of passages resulting from the alignment of the passages 42 with the passages 42a formed by a pair of adjoining recesses 44, such that when cement or mortar is poured from the top of a wall 52, all the spaces between the sides of the wall are filled with the cement or mortar to an appropriate level, thus forming when set a solid lattice within the wall 52 which reinforces the structure while at the same time holding all the blocks 10 together as a solid monolithic wall. The overlapped vertical joints formed at the ends of consecutive blocks 10 in a course, and the horizontal overlapped joints formed where superimposed courses of blocks 10 mate, provide an effective dam preventing the flowable quasi-liquid fresh mortar or cement from seeping from the interior of the blocks 10 to the exterior of the wall, thus eliminating the need for "tooling" mortar joints or scraping mortar from the outside surface of the wall. Once the cement or mortar is set and has solidified, the diverse blocks 10 are held solidly in assembly, with their abutting vertical and horizontal surfaces in mutual engagement without any mortar therebetween, thus effectively eliminating mortar joints for bounding the adjoining surfaces of the blocks. The mass of solid concrete or mortar, which fills all the spaces within the blocks and which strongly adheres to the interior surfaces of the blocks is concentrated along vertical runs through the passages formed by the aligned apertures 42 and 42*a* of the blocks and along horizontal runs through the apertures 51 formed between vertical passages by the cut-out portions 48 and 50 in the block transverse walls or cross members 46, such that behind each vertical as well as horizontal joint, there is a mass of concrete or mortar acting as an effective heat, cold, wind and moisture barrier.

As illustrated at FIG. 4, the building block of the invention may be modified such as to form a block 10*a*, substantially like block 10 of FIGS. 1–3, but having a ridge or step 26*a* and 28*a* disposed proximate the inner edge of the upper faces 26 and 28 of the side face slab portions 14 and 16, respectively, while the lower end faces 30 and 32 thereof are provided with correspondingly projecting steps 30*a* and 32*a* which, as best shown at FIG. 5, permit a plurality of blocks 10*a* to be superimposed still with the planar upper and lower faces 18 and 20 of the main body portion 12 in abutting relationship. Such a block configuration presents the advantage of a plurality of stepped and off-set surfaces being disposed at the horizontal joints between adjoining blocks, thus forming a very efficient dam preventing mortar or cement poured into a wall made of blocks 10 a from seeping to the surfaces of the wall before setting, while forming an improved moisture and heat barrier between the block sidewalls. If so desired, the end faces 22 and 24 of the blocks, or, alternately, the end faces 34, 36, 38 and 40 of the side slab portions 14 and 16, respectively, may also be provided with appropriate complementary offset recessed and projecting stepped surfaces, not shown, for the purpose of improving the quality of the vertical joints.

FIG. 6 illustrates a building full block 10b substantially like the block 10 of FIG. 1, except that the main body portion 12 of the block is provided with transverse walls 46*b*, best shown at FIG. 7, ending at the top and at the bottom thereof a substantial distance from the upper uniplanar edge face 18 and the lower uniplanar edge face 20 respectively, of the main body portion 12*b* such that when superimposed courses of blocks 10*b* are laid, the cross area of the horizontal passages 54 for the cement or mortar poured therein to flow before setting is substantially larger than the horizontal passages provided by the structure of the blocks 10 of FIG. 1.

For the purpose of erecting a structure, such as, for example, a building shell having four exterior walls connected at right angle at each corner, the invention contemplates the use of symmetrical corner blocks as shown at 56*a* and 56*b* at FIG. 8. The corner blocks 56*a* and 56*b* are substantially like block 10 of FIG. 1 except that the right hand end of the block 56*a*, as shown in the figure, is provided with a solid end wall 58*a*, and the left hand end of the corner block 56*a* is similarly provided with a solid end wall 58*b*. The outer surface of the end wall 58*a*, and 58*b* respectively, is at a distance from the plane formed by the lateral end faces 59*a*, and 59*b* respectively, of the block main body portion which is equal to the distance between the lateral end faces 22 and 24 of the main body portion 12 of the block 10 of FIG. 1. In other words, the corner blocks 56*a* and 56*b* are shorter than the full blocks 10, precedently described, by an amount equal to the distance of projection of the main body portion 12 of the blocks relative to the side face slab portions. The main body portion 12a of the corner block 56*a* is downwardly recessed relative to the top edges of the integral side face slab portions 60*a*–62*a* and of the end wall 58*a* while the lower end face of the main body portion of the corner block projects below the lower edges of the side face slab portions and end wall. The lateral end 59*a* of the corner block main body portion projects beyond the lateral ends of the side face slab portions. Similarly the main body portion 12*b* of the corner block 58*b* is downwardly offset relative to the side face slab portions 64*b*–66*b*, and projects relative to the lateral ends of the side face slab portions, as shown at 59*b*. The side face slab portions 62*a* of the corner block 56*a* and 64*b* of the corner block 56*b* directed toward the interior of the wall are recessed as shown at 68*a* and 68*b*, respectively, such as to accept the projecting end faces 24 of the main body portion 12 of a block 10, FIG. 1. The recessed portion of the side face slab portion is provided at the top and bottom with cut-out portions 70*a* and 71*a*, and 70*b* and 71*b* respectively, for permitting horizontal flow of fluid mortar or cement poured inside a wall.

Figure 11:
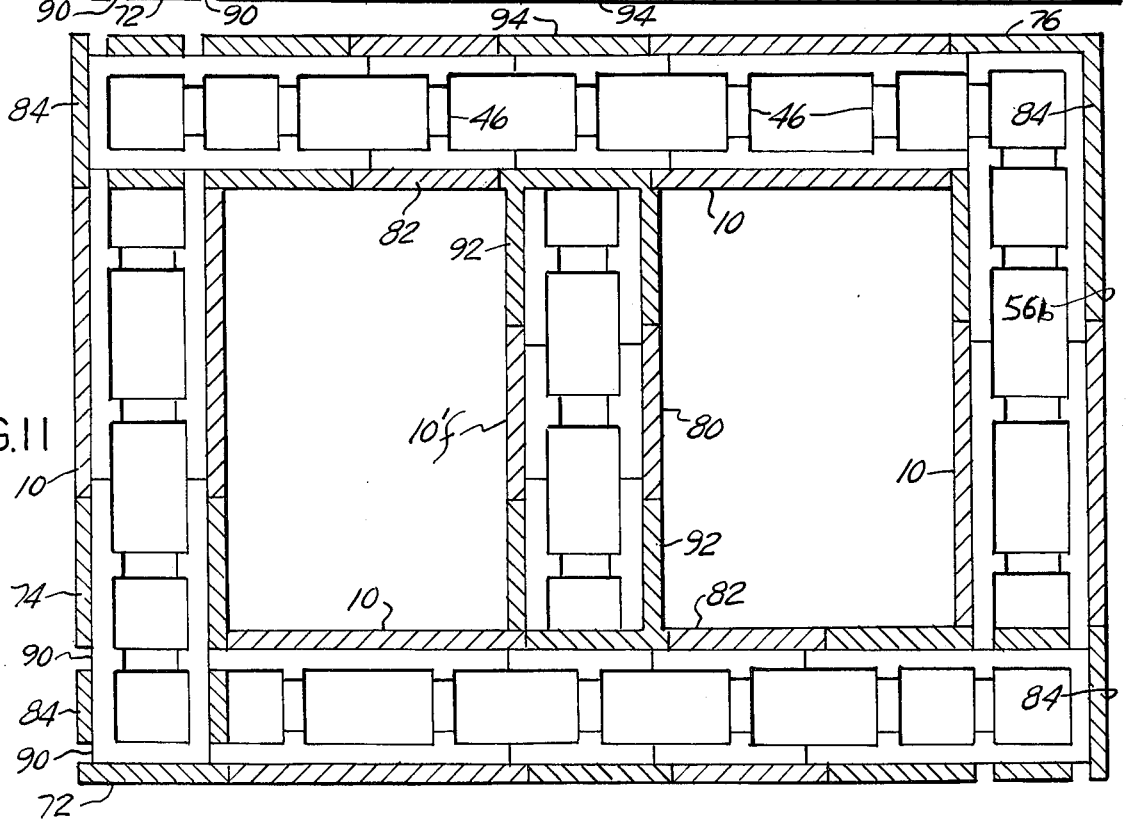
FIG. 11 is a view similar to FIG. 10, but showing a section along line 11—11 of FIG. 9.

FIG. 9 represents an end view and FIGS. 10 and 11 illustrate transverse sections at diverse levels through a structure consisting of four exterior walls 72, 74, 76, and 78, and an interior wall 80, each made of a variety of blocks shaped according to the teaching of the present invention in diverse modifications for adaptation to corner blocks, half-blocks, and interior wall connecting blocks for joining exterior walls to interior walls such as exterior walls 76 and 72 to interior wall 80. The full blocks are shown at 10, such full blocks being like the block 10 of FIG. 1. Half-blocks are shown at 82. The half-blocks are structurally the same as the full blocks 10, except that they are only half the length of a full block and are provided only with a single transverse wall or cross member 46, preferably slightly thicker, for added strength, than the transverse walls of a full block.

Standard corner blocks 84 are shown in position at each corner of the structure for joining two right angled walls. Each standard corner block 84 has an overall exterior length equal to the overall exterior length of a standard block 10 less the amount that the side face slab portions project from the main body portion, and has a modified end provided with a plane end wall 86. The side face slab portions 88 of each corner block 84 has a pair of vertically disposed parallel grooves 90 for accepting the projecting end faces 24 of an abutting standard block 10. Because the grooves 90 are formed on both sides of the block 84 so as to provide a universal corner block which may be used with a standard length block, or half length block, abutting on one side or the other, the grooves 90 are apparent on an exterior wall on every other corner block 84, as shown at FIG. 9. The grooves 90 may be left apparent, as they actually provide a decorative effect, or, if so desired, they may be filled with cement. Corner blocks such as corner blocks 56*a* and 56*b* of FIG. 8, one of which is shown at FIG. 11 may be used instead of the corner blocks 78.

Interior wall connecting blocks, as shown at 92, are molded with the same overall length as the corner blocks 88, but then are provided with a solid wall 94 as an exterior end face. The end wall 94 has steps at both lateral ends, as shown at 96 and 98 respectively, such as to interlock with the adjoining blocks on the exterior side thereof, such steps being repeated, as shown at 96*a* and 98*a*, at the locations corresponding to the interior of the wall. The general shape of an interior wall connecting block 92 is substantially that of a pair of half-length blocks, such as block 82, molded in a single integral piece with the longitudinal axes of the two half-length blocks disposed at right angles to each other in the form of the capital letter T. The planes of steps 96–96*a* and 98–98*a* are offset laterally relative the sidewall surface 97 and 99 of the interior wall connecting blocks one half the increment of stagger between the lateral end faces of the main body portion and of the side face slab portions of the other block elements.

Figures 12, 13, 13A, 13B, 14, 15, 16, 17, 18, 19:
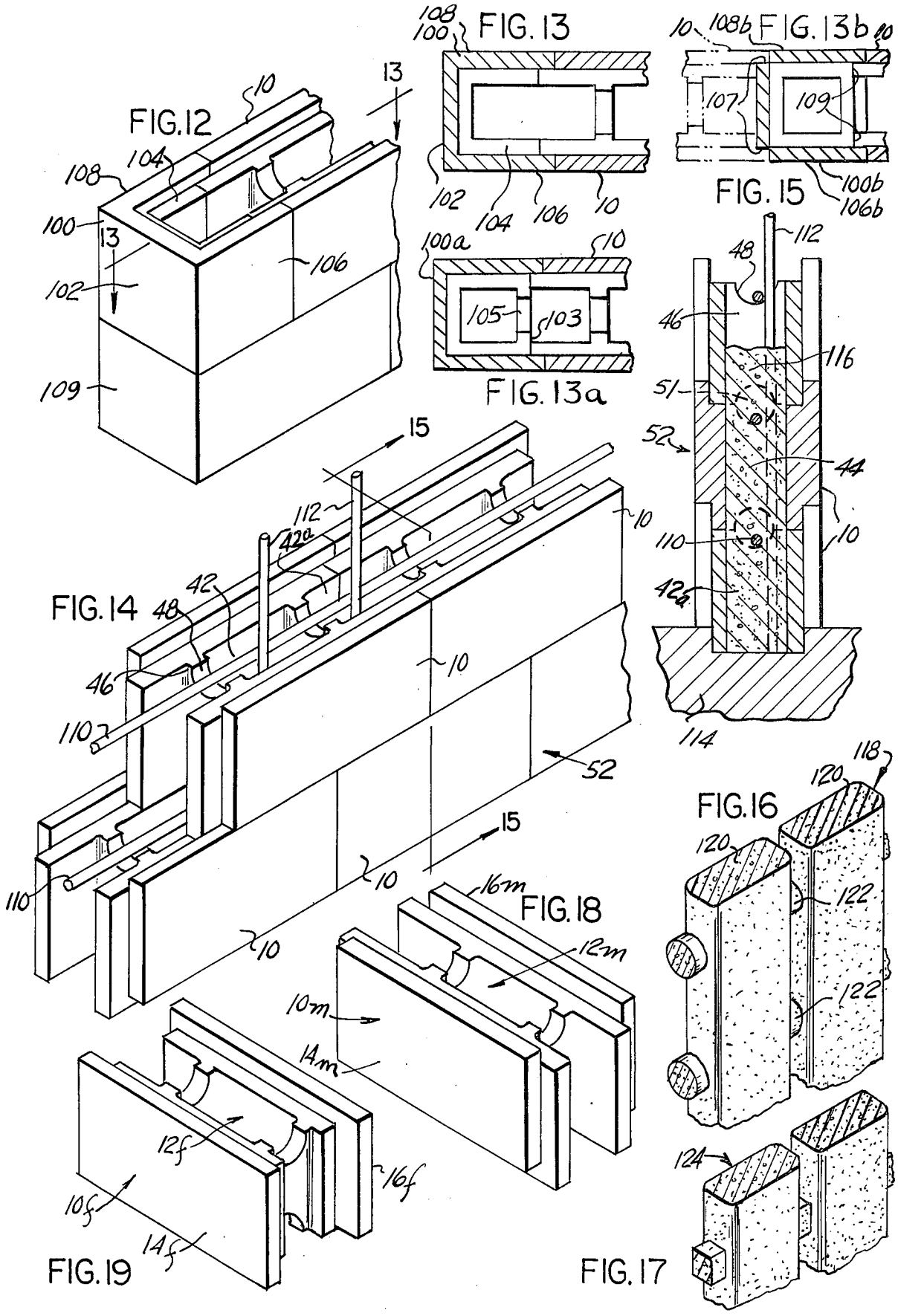
FIG. 12 is a perspective view of a portion of a wall end, such as for a door or window opening.
FIG. 13 is a sectional along line 13—13 of FIG. 12.
FIGS. 13*a* and 13*b* are views similar to FIG. 13 but showing modifications of the wall and block thereof.
FIG. 14 is a view similar to FIG. 2 but showing appropriate reinforcing rods disposed through a wall portion prior to pouring of cement or mortar into the interior of the wall portion.
FIG. 15 is a section through a portion of the wall of FIG. 14 after pouring of cement or mortar into the interior of the wall.
FIG. 16 is a perspective view of the cement or mortar lattice inside of a wall built of building block elements according to FIG. 1.
FIG. 17 is a view similar to FIG. 16 but showing the resultant lattice when using elementary blocks according to FIG. 10.
FIGS. 18 and 19 are perspective views of further modifications of building block elements according to the present invention.

The present invention further contemplates wall end blocks for door jambs and window casings. Examples of wall end blocks are shown at FIGS. 12 and 13 wherein an end wall half-block 100 is illustrated provided with a solid end face 102 and an open end adapted to interlock with the end of the adjoining block 10. It will be immediately apparent that although the wall end half-block 100 has been illustrated with a main body portion 104 recessed at the open end of the block relative to the side face integral slab portions 106 and 108 thereof, the end blocks the main body portion 104 projecting laterally beyond the side face slab portions thereof in order to interlock, where required as for example on the opposite side of a door jamb or window casing, with the recessed lateral end of a standard block 10. Wall end full blocks, as shown at 109 at FIG. 12, are substantially alike the wall end half-block 100, except that they are twice the length of a half-block.

FIG. 13*a* illustrates a modification 100a of a wall end block, similar to the wall end half-block 100 of FIGS. 12 and 13, except that it is provided with a transverse wall 103, having a cut-out section 105 on the top thereof and preferably a cut-out portion on the bottom thereof, not shown, the transverse wall 103 being proximate the end of the block interlocking with the end of a universal block 10. A modification of a wall end half-block is shown at 100*b* at FIG. 13*b*, provided with a recessed end 109 for accepting the projecting lateral end of a universal block 10, the other end of the half-block 100*b* being provided with parallel stepped recesses 107 for accepting the projecting end face of the side slab portions of the other end of a block 10, as shown in phantom line. The half block 100*b* is therefore a wall end block which may be used interlocking with either end of a universal full block 10.

Where it is desired to erect a structure of substantial height appropriate reinforcing metal rods or plates may be disposed, prior to pouring of cement or mortar into the spaces within the blocks, as illustrated at FIG. 14 wherein horizontally disposed reinforcing rods 110 are shown placed such as to be supported by the recess or cut-out portion 48 at the top of the cross member or transverse wall 46 of each block 10, and vertical rods 112 are placed through the vertically aligned apertures 42*a* and 44 in the blocks.

FIG. 15 is a cross section through a wall structure 52 supported from the ground by an appropriate footing 114, the interior of the blocks 10 having been provided with appropriate horizontally disposed reinforcing rods 110 and vertically disposed reinforcing rods 112, the latter being held in position by any convenient means such as tying with wire at diverse locations with the horizontally disposed reinforcing rods 110, and mortar or cement 116 having been poured into the interior of the blocks such as to fill all the voids and spaces in the vertical passages 42 and 44 and in the horizontal passages 51. It is immediately apparent that the building blocks 10 are an integral part of the wall structure 52 and that, after the cement or mortar 116 has set, the solidified cement or mortar mass is intimately bonded to the interior surfaces of the blocks, such that the wall structure 52 is for all practical purposes a strong monolithic structure.

FIG. 16 illustrates the cement or mortar lattice 118 resulting from the cement or mortar having set in the inside of a structure, such as a wall, made of building blocks having the configuration of the block 10 of FIG. 1, the building blocks being assumed to be removed for the purpose of showing the configuration of the cement or mortar lattice 118. It can be seen that the lattice 118 consists of a plurality of juxtaposed vertical pillars 120 resulting from the cement or mortar having set in the vertically aligned passages 42 and 44 in the center and at the ends of the superimposed blocks forming the diverse courses of the wall (FIG. 15). The pillars 120 are interconnected by means of horizontal cylindrical integral members 112 formed by the cement or mortar having set in the horizontal apertures 51 (FIG. 15) between the vertically disposed cavities or passages in the blocks. FIG. 17 illustrates a lattice 124 resulting from the use of blocks such as blocks 10*b* of FIG. 6.

The invention also contemplates providing adaptor blocks such as blocks 10m and 10*f* shown at FIGS. 18 and 19, for achieving a transgression from a block oriented in a predetermined direction to an adjoining block oriented in an opposite direction . The male type connector block 10*m* of FIG. 18 has a main body portion 12*m* which projects on both ends of the block beyond the side face integral slab portions 14*m* and 16*m*. Such a block may be inserted between two standard blocks, such as block 10 of FIG. 1, for interconnecting the two blocks with the recessed end faces 22 of the main body portion 12 of the blocks opposed to each other. In a reciprocal manner, the female type connector block 10*f* of FIG. 19 having its main body portion 12*f* recessed relative to the ends of the side face integral slab portions 14*f* and 16*f* acts as a connecting member able to interlock with two standard blocks presenting in opposition their respective projecting main body portion. The male and female connector blocks, 10*m* and 10*f*, may be made in half block lengths and a half female connector block is shown at 10′*f* at FIGS. 10 and 11.

Although the diverse building block elements of the invention have been described and illustrated with the main body portion of the blocks downwardly offset relative to the side face slab portions, it will be readily apparent that a configuration whereby the main body portion of the blocks is upwardly offset is the full equivalent thereof, and that wall structures may be built by superimposing courses of building blocks according to the present invention with the projecting portion of the main body portion of the blocks disposed upwardly, rather than downwardly as illustrated in the drawing.

Having thus described the invention, modifications whereof will be apparent to those skilled in the art, what is claimed as new is as follows:

1. A modular system of building construction comprising full blocks, half blocks, adaptor blocks, wall end blocks, corner blocks and wall junction blocks, each consisting of an interlocking block element comprising a main body portion vertically offset a predetermined substantially constant amount relative to a pair of opposed side slab portions integrally formed with said main body portion, said side slab portions being substantially mutually parallel and of equal dimensions, said main body portions being horizontally offset at least at one lateral end thereof relative to said side slab portions, whereby a plurality of said block elements are horizontally and vertically interlocked by overlapping stepped joints in surface to surface engagement when laid end to end in superimposed courses, each of said stepped joints being defined relative to a block element by at least a pair of edge surfaces disposed substantially one at right angle to the other, said main body portion of each block element being hollow and provided with at least one recess extending vertically from upper face to lower face of said main body portion and open to at least one lateral end of said body portion, said recess continuously extending horizontally and vertically behind said overlapping stepped joints and being adapted to receive mortar or cement poured within said wall structure for uniting each of said block elements with each other by allowing said concrete or cement to flow vertically and horizontally within said wall structure only and to set to a solid from whereby set mortar or cement is present within said wall structure behind each horizontal and vertical overlapping stepped joint forming an uninterrupted moisture, heat and wind barrier and said overlapping stepped joints forming a dam preventing seepage of mortar or cement through said joints to the exterior of said wall structure.

2. The modular system of claim 1 wherein said full block and said half blocks each have said main body portion projecting relative to said side slab portions at a lateral end of said block and recessed relative to said side slab portions at the other lateral end of said block of a substantially equal distance.

3. The modular system of claim 1 wherein at least one of said adaptor blocks has said main body portion projecting of a substantially equal distance at each lateral end of said block.

4. The modular system of claim 1 wherein at least one of said adaptor blocks has said main body portion recessed of a substantially equal distance at each lateral end of said block.

5. The modular system of claim 1 wherein said wall end blocks each have a lateral end uninterrupted wall portion closing said recess on one side.

6. The modular system of claim 1 wherein said corner blocks each have a lateral end uninterrupted wall portion closing said recess on one side, a section removed from one of said opposed side slab portions proximate said lateral end wall portion of a width corresponding to the width of said main body portion and a cut-out section removed from the top and bottom of said main body portion corresponding to said section removed from one of said side slab portions.

7. The modular system of claim 1 wherein said wall junction blocks each have an uninterrupted wall disposed at a longitudinal end, a recess disposed at the other longitudinal end, and a recess disposed at a portion of each lateral end, said recesses being formed by said main body portion offset relative to said side slab portions for engagement with the lateral ends of adjoining blocks.

8. Interlocking block elements for erecting a wall structure having overlapping mortar-less joints, each of said interlocking block elements comprising a main body portion vertically offset of a predetermined substantially constant amount relative to a pair of opposed side slab portions integrally formed with said main body portion, said side slab portions being substantially mutually parallel and of equal dimensions, said main body portion being horizontally offset at least at one lateral end thereof relative to said side slab portions, whereby a plurality of said block elements are horizontally and vertically interlocked by overlapping stepped joints in surface to surface engagement when laid end to end in superimposed courses, each of said stepped joints being defined relative to a block element by at least a pair of edge surfaces disposed substantially one at right angle to the other, said main body portion of each block element being hollow and provided with at least one recess extending vertically from upper face to lower face of said main body portion and open to at least one lateral end of said body portion, said recess continuously extending horizontally and vertically behind said overlapping stepped joints and being adapted to receive mortar or cement poured within said wall structure for uniting each of said block elements with each other by allowing said concrete or cement to flow vertically and horizontally within said wall structure only and to set to a solid form whereby set mortar or cement is present within said wall structure behind each horizontal and vertical overlapping stepped joint forming an uninterrupted moisture, heat and wind barrier and said overlapping stepped joints forming a dam preventing seepage of mortar or cement through said joints to the exterior of said wall structure.

9. The block element of claim 8 wherein said main body portion has said recess at one lateral end and the other lateral end is closed by an integral solid wall portion.

10. The block element of claim 8 wherein said main body portion has said recess at each lateral end thereof, a transverse wall portion extending from side to side being disposed between said end recesses, said transverse wall portion having a cut-out section at the top and bottom for providing a passage between said recesses for said mortar or cement poured within said wall structure for forming said uniterrupted moisture, heat and wind barrier.

11. The block element of claim 8 wherein said main body portion has said recess at each lateral end thereof, a pair of transverse wall portions extending from side to side being disposed between said end recesses and said transverse wall portions being disposed apart from each other such as to define a vertical intermediate recess, said transverse wall portions having each a cut-out section at the top and bottom for providing a passage between said recesses for said mortar or cement poured within said wall structure for forming said uninterrupted moisture, heat and wind barrier.

12. The block element of claim 9 further comprising at least one transverse wall portion extending from side to side disposed apart from said end wall portion, said end wall portion and said transverse wall portion defining a vertical intermediate recess, said transverse wall portion having a cut-out section at the top and bottom for providing a passage between said recesses for said mortar or cement poured within said wall structure for forming said uninterrupted moisture, heat and wind barrier.

13. The block element of claim 12 further comprising a pair of vertical parallel grooves formed on the exterior surface of said side slab portions, said grooves being adapted to accept the projecting ends of the main body portion of a block element abutting one of said side slab portions.

14. The block element of claim 12 further comprising a recess on the exterior surface of at least one of said slab portions adapted to accept the projecting ends of the main body portion of a block element abutting said side slab portion.

15. The block element of claim 14 wherein a cut-out section is removed from the top and bottom of said main body portion corresponding to said recess in said side slab portion.

16. The block element of claim 8 further comprising a stepped upper and lower edge on said side slab portion, said stepped lower edge of each block element mating the stepped upper edge of another block element.

17. The block element of claim 10 wherein said main body portion is recessed relative to said side slab portion at both lateral ends of said block element.

18. The block element of claim 11 wherein said main body portion is recessed relative to said side slab portions at both lateral ends of said block element.

19. The block element of claim 10 wherein said main body portion projects relative to said side slab portions at both lateral ends of said block element.

20. The block element of claim 11 wherein said main body portion projects relative to said side slab portions at both lateral ends of said block element.

21. The block element of claim 11 wherein said main body portion projects relative to said side slab portions at one lateral end of said block element and is recessed relative to said side slab portions at the other lateral end of said block element.

* * * * *

UNITED STATES PATENT OFFICE

CERTIFICATE OF CORRECTION

Patent No. 4,075,808 Dated February 28, 1978

Inventor(s) Sanford Pearlman

It is certified that error appears in the above-identified patent and that said Letters Patent are hereby corrected as shown below:

Column 1, line 40, after "masonry" insert -- elements --.

Column 7, line 3, after "blocks" insert -- may also be molded in a reciprocal configuration, namely with --.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*